US006231699B1

(12) United States Patent
Kelly et al.

(10) Patent No.: US 6,231,699 B1
(45) Date of Patent: May 15, 2001

(54) HEAT TREATMENT OF GAMMA TITANIUM ALUMINIDE ALLOYS

(75) Inventors: Thomas J. Kelly, Cincinnati; Michael J. Weimer; Curtiss M. Austin, both of Loveland, all of OH (US); Blair London, San Luis Obispo, CA (US); Donald E. Larson, Jr.; Dean A. Wheeler, both of North Muskegon, MI (US)

(73) Assignee: General Electric Company, Cinncinnati, OH (US)

( * ) Notice: Subject to any disclaimer, the term of this patent is extended or adjusted under 35 U.S.C. 154(b) by 0 days.

(21) Appl. No.: 08/262,168

(22) Filed: Jun. 20, 1994

(51) Int. Cl.[7] ..... C22F 1/18
(52) U.S. Cl. ..... 148/670; 148/421
(58) Field of Search ..... 148/669, 670, 148/671, 421; 420/418, 421

(56) References Cited

U.S. PATENT DOCUMENTS 5,205,875 * 4/1993 Huang ..... 148/421
5,226,985 * 7/1993 Kim et al. ..... 148/671
5,350,466 * 9/1994 Larsen, Jr. et al. ..... 148/421

* cited by examiner

*Primary Examiner*—Scott Kastler
(74) *Attorney, Agent, or Firm*—Andrew C. Hess; David L. Narciso

(57) ABSTRACT

A gamma titanium aluminide alloy article, is prepared using a piece of a gamma titanium aluminide alloy having a composition capable of forming alpha, alpha-2, and gamma phases. The alpha transus temperature of the gamma titanium aluminide alloy piece is determined. The gamma titanium aluminide alloy piece is consolidated by hot isostatic pressing at a temperature of from about 50 F. to about 250 F. below the alpha transus temperature and at a pressure of from about 10,000 to about 30,000 pounds per square inch, for a duration of from about 1 to about 20 hours. The piece is heat treated at a temperature of from about 5 F. to about 300 F. below the alpha transus temperature for a time sufficient to refine the microstructure and generate a microstructure comprising from about 10 to about 90 volume percent gamma phase. The step of heat treating is conducted at a temperature of from about 45 F. to about 200 F. above the temperature of the step of hot isostatic pressing.

11 Claims, 3 Drawing Sheets

200X

HEAT TREATMENT OF GAMMA TITANIUM ALUMINIDE ALLOYS

BACKGROUND OF THE INVENTION

This invention relates to the production of alloys, and, more particularly, to the preparation and heat treatment of alloys of the gamma titanium aluminide type.

Titanium aluminides are a class of alloys whose compositions include at least titanium and aluminum, and typically some additional alloying elements such as chromium, niobium, vanadium, tantalum, manganese, and boron. The gamma titanium aluminides are based on the gamma phase found at nearly the equiatomic composition, with roughly 50 atomic percent each of titanium and aluminum, or slightly reduced amounts to permit the use of other alloying elements. The titanium aluminides, and particularly the gamma titanium aluminides, have the advantages of low density, good low and intermediate temperature strength and cyclic deformation resistance, and good environmental resistance.

Gamma titanium aluminides have application in aircraft engines. They can potentially be used in applications such as low-pressure turbine blades and vanes, bearing supports, compressor casings, high pressure and low pressure hangars, frames, and low pressure turbine brush seal supports.

One area of continuing concern in the titanium aluminides, and particularly the gamma titanium aluminides, is their low-to-moderate levels of ductility. Ductility is the measure of how far a material can elongate before it fails, and is linked to other properties such as fracture resistance. The gamma titanium aluminides elongate only 1–4 percent at most prior to failure, and have a steeply rising stress-strain curve. Maintaining the strength and resistance of the material to premature failure are therefore highly dependent upon controlling the alloy ductility.

In this context of low-to-moderate ductilities, a key consideration is the ability to achieve and maintain some known minimum ductility. The development of specifications for the use of the material normally start with some minimum property that can be reached on a consistent basis, and then a safety factor is applied. Consistency and controllability become important considerations, and are not easily achieved due to the relatively low ductilities experienced in these materials.

There is therefore a need for an approach to achieving a minimum set of tensile properties, including as high a consistent elongation to failure as possible, in gamma titanium aluminide alloys. The approach must permit those properties to be achieved consistently and controllably in the alloys of interest. The present invention fulfills this need, and further provides related advantages.

SUMMARY OF THE INVENTION

The present invention provides a processing and heat treatment procedure for gamma titanium aluminide alloys. This approach achieves ductilities of about 1–4 percent in these materials, which are comparable with the best elongations achieved by other techniques. Moreover, the processing of the invention permits the consistent development of specified minimum ductilities of at least about 1 percent.

In accordance with the invention, a method of producing a gamma titanium aluminide alloy article comprises the steps of providing a piece of gamma titanium aluminide alloy having a composition capable of forming alpha, alpha-2, and gamma phases and determining the alpha transus temperature of the gamma titanium aluminide alloy piece. The method further includes consolidating the gamma titanium aluminide alloy piece at elevated temperature to reduce porosity therein, and heat treating the piece at a temperature of from about 5 F. to about 300 F. below the alpha transus temperature for a time sufficient to generate a refined microstructure comprising from about 10 to about 90 volume percent gamma phase.

The consolidation preferably is accomplished by hot isothermal pressing at a temperature below the alpha transus temperature and the heat treatment temperature. More particularly, and further in accordance with the invention, the consolidating is accomplished by hot isostatic pressing the gamma titanium aluminide alloy piece at a temperature of from about 50 F. to about 250 F. below the alpha transus temperature and at a pressure of from about 20,000 to about 30,000 pounds per square inch, for a time of from about 1 to about 20 hours. The heat treating is preferably conducted at a temperature of from about 45 F. to about 200 F. above the temperature of the step of hot isostatic pressing.

A key to the present invention is the recognition of the high degree of variability among gamma titanium aluminide alloys, even those meeting narrow compositional standards. The alpha transus temperature of gamma titanium aluminide alloys varies strongly with changes in the aluminum content of the alloy. In turn, it is difficult to control the aluminum content of the alloy exactly in the melting operation. The result is that it is difficult to prescribe the aluminum content of the gamma titanium aluminide precisely, with certain knowledge that the prescribed aluminum content will be present in the final product. Prior processing techniques have not recognized this variability, resulting in a lack of consistency in the final product.

The present approach is designed to improve the properties of the final product, and improve the certainty of achieving the improved results. Two steps are taken with these characteristics in mind. First, the alpha transus temperature of the alloy is determined for each lot of material. The alpha transus temperature may be determined by any appropriate approach, with direct measurement of the transformation temperature preferred. Second, the subsequent processing temperatures are selected in relation to the determined alpha transus temperature, not in terms of a fixed temperature or temperature range to be applied in all cases. The result is both improved properties and improved consistency of these improved properties in the final product.

The present invention provides an important advance in the art of gamma titanium aluminide processing. The approach of the invention tailors the processing to the actual alloy processed and not to an intended or prescribed alloy, which may not be reached in the actual alloy processed. It is conventional metallurgical practice to select processing parameters in relation to the prescribed alloy, as in most instances the variability is not great. That approach is simply not sufficient in the present processing environment.

Other features and advantages of the present invention will be apparent from the following more detailed description of the preferred embodiment, taken in conjunction with the accompanying drawings, which illustrate, by way of example, the principles of the invention.

DETAILED DESCRIPTION OF THE PREFERRED EMBODIMENTS

Figure 1:
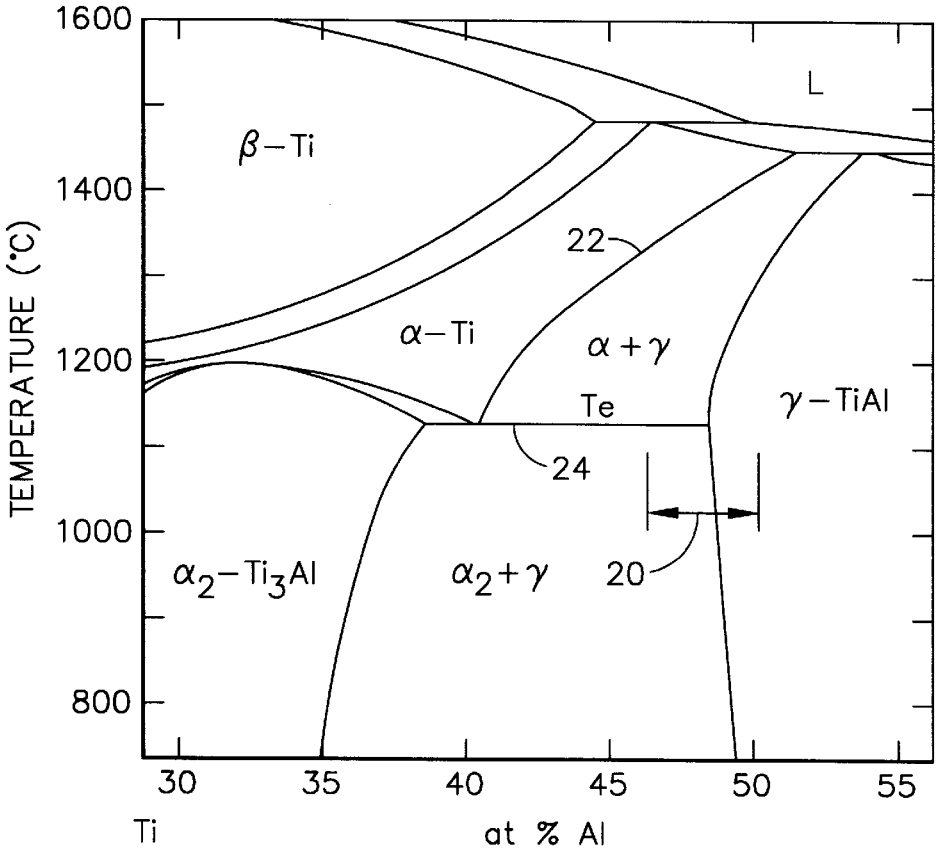
FIG. 1 is a portion of the phase diagram of the titanium aluminide system.

The present invention provides a method of producing a gamma titanium aluminide article, which is based upon the phase transformations in the system. FIG. 1 shows the central portion of the equilibrium titanium-aluminum phase diagram, and the following discussion refers to that phase diagram. The phase diagram is in atomic percent, and all compositions herein are stated in atomic percent unless indicated to the contrary. The operability of the present invention does not depend upon the accuracy of the phase diagram as depicted, and in fact permits successful preparation of articles even if the phase diagram is incorrect as to some details.

Figure 2:
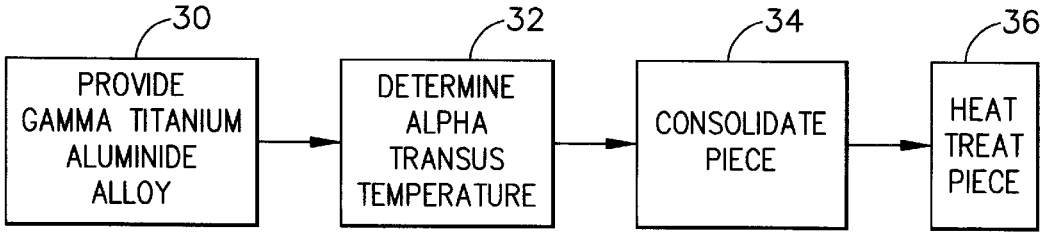
FIG. 2 is a flow chart for the processing approach of the invention.

The invention is applicable to gamma titanium-aluminum alloys which have compositions capable of forming alpha, alpha-2, and gamma phases at the indicated temperatures, and such an alloy is first provided, numeral 30 of FIG. 2. (These alloys are often termed "gamma" titanium aluminides in the art, even though they are not fully within the gamma phase field. That usage is adopted here.) The preferred compositions have from about 46 to about 50 atomic percent aluminum, as indicated at numeral 20, and are therefore at the high end of the operable range. When such a composition in this range is cooled from the molten state, it passes through a high-temperature peritectic reaction and into the alpha-titanium phase field (termed herein an "alpha" phase). Upon cooling, the alloy passes into an alpha-plus-gamma phase field. The line between the alpha and alpha-plus-gamma phase fields is termed the alpha transus 22. Upon further cooling, the alloy passes through a eutectoid temperature 24, and into an alpha-2-plus-gamma phase field.

When such an alloy is melted and cooled as indicated, the piece may have a considerable amount of porosity and its microstructure is irregular. These characteristics lead to low and uncontrolled ductility. The alloy piece is therefore processed by the present approach to improve these properties.

The first step in the processing is to determine the alpha transus (22) temperature for the piece, numeral 32 of FIG. 2. This is usually accomplished by making the determination for the lot of material or the melt from which the piece is taken, but in some cases knowledge of the exact value may be so important that a small sample is excised from the piece, in an area that would be removed in any event in subsequent machining, and the alpha transus temperature for that small sample is determined. The alpha transus temperature is determined in order to establish the temperatures for the subsequent processing steps.

In some alloy systems, it would be sufficient to rely upon the nominal alloy composition and the phase diagram alpha transus temperature. Thus, at least in theory, if one knows the nominal aluminum content of the piece, the alpha transus temperature 22 can be determined directly from the phase diagram of FIG. 1. However, in practice, it is very difficult to prepare a gamma titanium aluminide alloy to precisely a preselected nominal composition, for a variety of reasons associated with the melting practices for titanium. Further, it is difficult to perform precise aluminum content measurements by conventional chemical analysis techniques available in a commercial setting. The alpha transus temperature 22 slopes steeply as a function of aluminum composition, as seen in the phase diagram of FIG. 1, and therefore even a relatively small difference between the actual alloy composition and the nominal composition can result in a significant difference between the actual alpha transus temperature and that which is believed to be in effect.

The alpha transus temperature is therefore determined for the piece being treated, and subsequent treatment temperatures are keyed to the measured alpha transus temperature rather than to some nominal value or to some fixed temperature values. To determine the alpha transus temperature, the preferred approach is to heat several pieces to different temperatures near the expected alpha transus temperature, and then quench those pieces. The structure is examined metallographically. For treatment temperatures below the alpha transus temperature, gamma grains and transformation products of alpha phase are observed. For temperatures at or above the alpha transus temperature, only alpha phase transformation products are observed, usually in the form of large lamellar colonies. An alternative approach is to use a gradient bar which is heated to different temperatures along its length. Yet another, less acceptable approach that is sometimes operable is to measure the aluminum content and to rely upon the accuracy of the phase diagram. Once the alpha transus temperature is determined, the further processing steps are undertaken.

A preferred processing for the piece is first to reduce the porosity by consolidation of the piece, numeral 34 of FIG. 2, and then to establish a favorable microstructure by heat treatment, numeral 36 of FIG. 2. The consolidation involves a slight shrinkage of the piece as porosity is removed, but there is no gross deformation as is often used in thermomechanical processing of materials. Thus, the present processing is adapted for improving alloys to be used in essentially their as-cast form.

Figure 3:
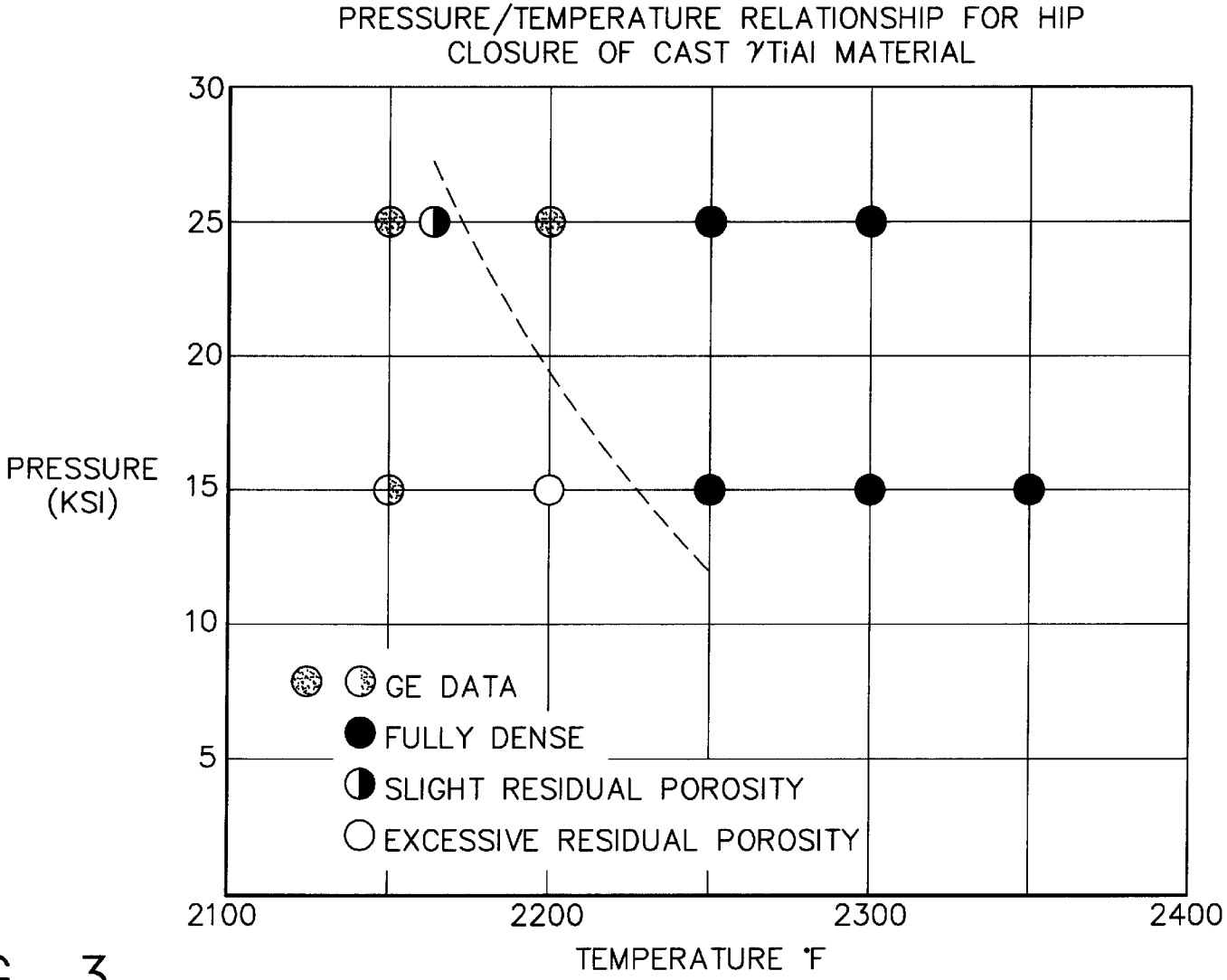
FIG. 3 is a graph of hot isostatic pressing pressure versus temperature with an indication of the resulting structure.

Consolidation step 34 is preferably accomplished by hot isostatic pressing (known as "HIPping"). The piece is heated to the hipping temperature, and an external pressure is applied. The hot isostatic pressing is accomplished at a temperature that is preferably from about 50 F. to about 250 F., most preferably from about 125 F. to about 225 F., below the alpha transus temperature. The hot isostatic pressing is accomplished at a pressure of greater than about 20,000 pounds per square inch (psi), preferably from about 20,000 to about 30,000 pounds per square inch, and most preferably from about 20,000 to about 25,000 pounds per square inch. The hot isostatic pressing must be of sufficient duration to close the porosity. From about 1 to about 20 hours is preferred, and from about 2 to about 8 hours is most preferred. If the temperature, the pressure, or the duration is too low, the porosity cannot be successfully closed. The temperature is preferably limited so that the hot isostatic pressing is accomplished in the alpha plus gamma phase field to begin the required transformations. The upper limits of pressure and time are selected for process economics. The required pressure to achieve a fully dense structure by hot isostatic pressing increases with decreasing temperature, as shown in FIG. 3.

During the isostatic pressing operation, the phase transformations to the final structure begin. Consolidation at a temperature below the alpha transus produces an alpha plus gamma structure. Upon cooling from this treatment, the alpha phase transforms to alternating platelets of gamma plus alpha-2 phases. The result is gamma phase grains mixed with a gamma plus alpha-2 lamellar structure. This duplex structure is the desirable type of final structure, but is not sufficiently completely transformed.

To reach the final structure, the piece is heat treated 36 at a heat treating temperature. The heating can be directly from the hot isostatic pressing temperature, or from a lower temperature after intermediate cooling. The heat treating temperature is from about 5 F. to about 300 F. below the alpha transus temperature, preferably from about 50 F. to about 100 F. below the alpha transus temperature. The heating must be below the alpha transus temperature to achieve the desired microstructure. If the heat treating is at too low a temperature, the required phase fractions cannot be achieved and the transformations are too slow.

The heat treatment is continued for a period sufficient to achieve a structure having from about 10 to about 90 volume percent, preferably from about 20 to about 80 volume percent, of the gamma phase as grains mixed with the alpha phase. The required duration of the heat treatment is determined routinely with a series of test specimens and micrographic studies to ascertain the time required to achieve the desired final structure. After the required period is complete, the piece is rapidly cooled to preserve the fine-scale transformed structure. The piece is not quenched, to avoid thermal cracking, but instead is cooled at a rate of about 100–150 F. per minute by gas fan cooling. Upon cooling, the alpha phase transforms to the duplex lamellar alpha-2 plus gamma structure, intermixed with the gamma phase grains.

The resulting structure achieves good ductility, for this type of alloy, of about 2 percent average. The minimum ductility is 1 percent, and can be achieved consistently.

In a preferred approach, the gamma titanium aluminide alloy is nominally of the composition, in atomic percent, of from about 46 to about 50 percent aluminum, from about 1 to about 3 percent chromium, from about 1 to about 5 percent niobium, balance titanium and incidental impurities. A secondary preferred composition is, in atomic percent, from about 43 to about 48 percent aluminum, from about 1 to about 3 percent chromium, from about 1 to about 5 percent niobium, from about 0.5 to about 2.0 percent boron, balance titanium and incidental impurities.

Figure 4:
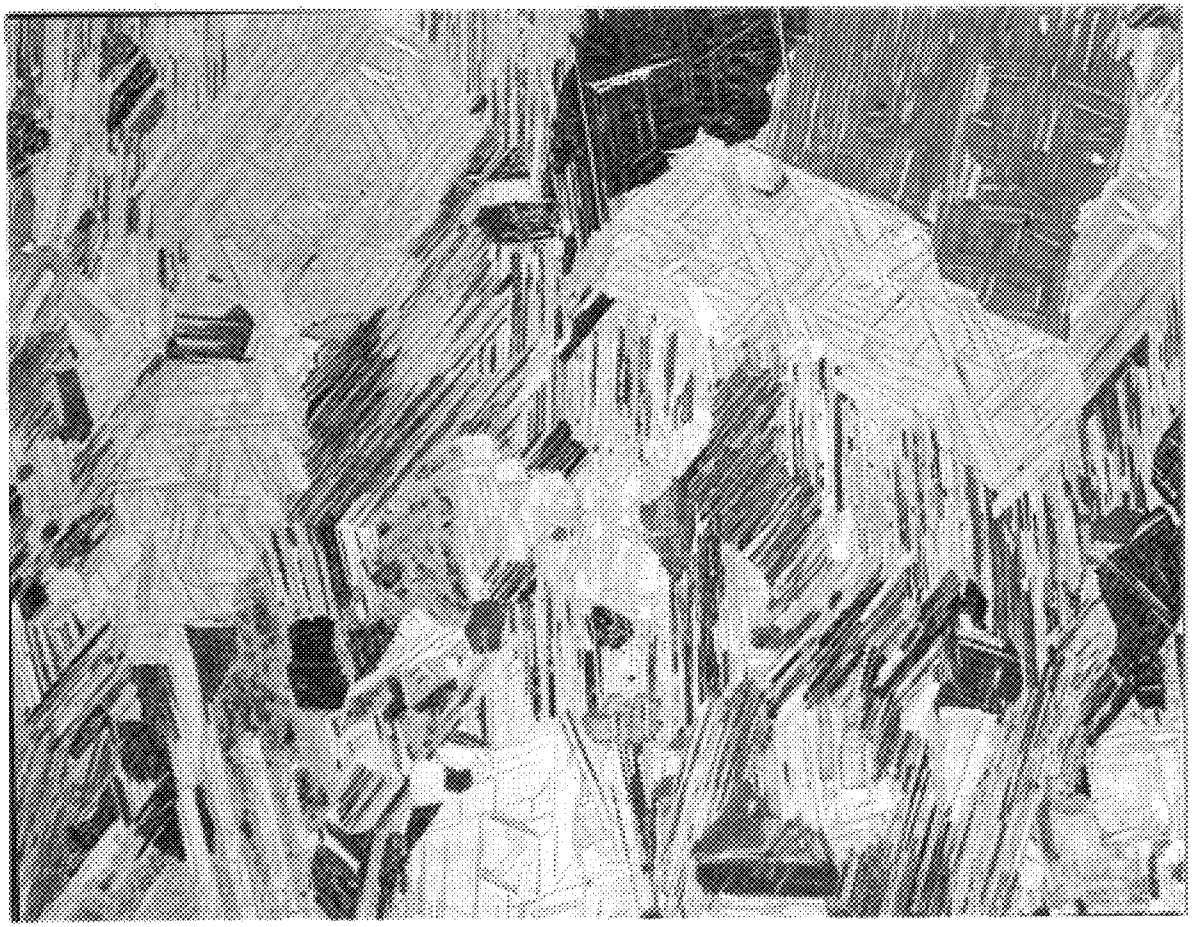
FIG. 4 is a photomicrograph of the final structure.

The processing for the most preferred alloy having 48 atomic percent aluminum, 2 atomic percent chromium, 2 atomic percent niobium, balance titanium and incidental impurities, is first to provide the alloy piece by casting to obtain a fine grain structure, and then to determine the alpha transus temperature. The alpha transus temperature is typically about 2450 F. The piece is hot isostatically pressed at a temperature of 2300 F. at a pressure of 25,000 psi for 4 hours, followed by a furnace cool. The piece is then heat treated at a temperature of 2375 F. for 20 hours, and rapidly furnace cooled by admitting argon into the furnace. FIG. 4 shows the resulting microstructure produced by this processing.

Typical mechanical properties for a turbine blade prepared by this approach are as follows: In the airfoil section, 2.3 percent elongation, 50.3 KSI (thousands of pounds per square inch) 0.2 percent yield strength, and 70.1 KSI ultimate tensile strength; in the dovetail section, 2.0 percent elongation, 49.4 KSI 0.2 percent yield strength, 68.2 KSI ultimate tensile strength, and 26.4 Kq.

This invention has been described in connection with specific embodiments and examples. However, it will be readily recognized by those skilled in the art the various modifications and variations of which the present invention is capable without departing from its scope as represented by the appended claims.

What is claimed is:

1. A method of producing a gamma titanium aluminide alloy article, comprising the steps of:

providing a piece of a gamma titanium aluminide alloy having a composition capable of forming alpha, alpha-2, and gamma phases;

determining the alpha transus temperature of the gamma titanium aluminide alloy piece;

consolidating the gamma titanium aluminide alloy piece at elevated temperature to reduce porosity therein; wherein the step of consolidating the titanium aluminide piece includes the step of hot isostatic pressing the gamma titanium aluminide alloy piece, and heat treating the piece at a temperature of from about 5 F. to about 300 F. below the alpha transus temperature for a time sufficient to generate a refined microstructure comprising from about 10 to about 90 volume percent gamma phase.

2. The method of claim 1, wherein the step of hot isostatic pressing is performed at a temperature of from about 50 F. to about 250 F. below the alpha transus temperature and at a pressure of from about 20,000 to about 30,000 pounds per square inch, for a duration of from about 1 to about 20 hours.

3. A method of producing a gamma titanium aluminide alloy article, comprising the steps of:

providing a piece of a gamma titanium aluminide alloy having a composition capable of forming alpha, alpha-2, and gamma phases;

determining the alpha transus temperature of the gamma titanium aluminide alloy piece;

hot isostatic pressing the gamma titanium aluminide alloy piece at a temperature of from about 50 F. to about 250 F. below the alpha transus temperature and at a pressure of from about 20,000 to about 30,000 pounds per square inch, for a duration of from about 1 to about 20 hours; and heat treating the piece at a temperature of from about 5 F. to about 300 F. below the alpha transus temperature for a time sufficient to refine the microstructure and generate a microstructure comprising from about 10 to about 90 volume percent gamma phase, the step of heat treating being conducted at a temperature of from about 45 F. to about 200 F. above the temperature of the step of hot isostatic pressing.

4. The method of claim 3, wherein the gamma titanium aluminide piece has a composition, in atomic percent, comprising from about 46 to about 50 percent aluminum.

5. The method of claim 3, wherein the gamma titanium aluminide piece has a composition, in atomic percent, consisting essentially of from about 46 to about 50 percent aluminum, from about 1 to about 3 percent chromium, from about 1 to about 5 percent niobium, balance titanium and incidental impurities.

6. The method of claim 3, wherein the gamma titanium aluminide piece has a composition, in atomic percent, consisting essentially of from about 43 to about 48 percent aluminum, from about 1 to about 3 percent chromium, from about 1 to about 5 percent niobium, from about 0.5 to about 2.0 percent boron, balance titanium and incidental impurities.

7. A method of producing a gamma titanium aluminide alloy article, comprising the steps of:

providing a piece of a gamma titanium aluminide alloy having a composition capable of forming alpha, alpha-2, and gamma phases;

determining the alpha transus temperature of the gamma titanium aluminide alloy piece;

hot isostatic pressing the gamma titanium aluminide alloy piece at a temperature of from about 125 F. to about 225 F. below the alpha transus temperature and at a pressure of from about 20,000 to about 25,000 pounds per square inch, for a duration of from about 2 to about 8 hours; and heat treating the piece at a temperature of from about 50 F. to about 100 F. below the alpha transus temperature for a time sufficient to refine the microstructure and generate a microstructure comprising from about 20 to about 80 volume percent gamma phase, the step of heat treating being conducted at a temperature of from about 50 F. to about 100 F. above the temperature of the step of hot isostatic pressing.

8. The method of claim 7, wherein the gamma titanium aluminide piece has a composition, in atomic percent, comprising from about 46 to about 50 percent aluminum.

9. The method of claim 7, wherein the gamma titanium aluminide piece has a composition, in atomic percent, consisting essentially of from about 46 to about 50 percent aluminum, from about 1 to about 3 percent chromium, from about 1 to about 5 percent niobium, balance titanium and incidental impurities.

10. The method of claim 7, wherein the gamma titanium aluminide piece has a composition, in atomic percent, consisting essentially of from about 43 to about 48 percent aluminum, from about 1 to about 3 percent chromium, from about 1 to about 5 percent niobium, from about 0.5 to about 2.0 percent boron, balance titanium and incidental impurities.

11. The method of claim 7, wherein the step of heat treating is performed immediately after the step of hot isostatic pressing, without allowing the piece to cool to an intervening lower temperature.

* * * * *